US005774938A

United States Patent [19]

Kent et al.

[11] Patent Number: 5,774,938

[45] Date of Patent: Jul. 7, 1998

[54] LOCKING DEVICE FOR LOCKING A CLOSURE IN AN OPEN POSITION

[75] Inventors: Erma W. Kent, 201 Bass Rd., Macon, Ga. 31210-2034; Daniel R. Nietzold; Loronzo H. Thomson, both of Warner Robins, Ga.

[73] Assignee: Erma W. Kent, Macon, Ga.

[21] Appl. No.: 802,240

[22] Filed: Feb. 19, 1997

[51] Int. Cl.[6] ..... E05D 11/10

[52] U.S. Cl. ..... 16/332; 16/330

[58] Field of Search ..... 16/330, 332, 327, 16/324, 328–331, 49, 50, 82

[56] References Cited

U.S. PATENT DOCUMENTS

| | | | |
|---|---|---|---|
| 294,746 | 3/1884 | Morgenstern . | |
| 769,035 | 8/1904 | Walter . | |
| 917,768 | 4/1909 | Jordan . | |
| 975,097 | 11/1910 | Wright . | |
| 1,060,641 | 5/1913 | Sladden . | |
| 1,125,265 | 1/1915 | Carter . | |
| 1,183,596 | 5/1916 | Sachse . | |
| 1,429,416 | 9/1922 | Fade . | |
| 1,440,713 | 1/1923 | Ausbourne . | |
| 1,465,912 | 8/1923 | Jensen . | |
| 1,489,679 | 4/1924 | Thornton . | |
| 1,946,837 | 2/1934 | Clayton . | |
| 2,097,651 | 11/1937 | Stangeland . | |
| 2,146,460 | 2/1939 | Beeler . | |
| 2,427,384 | 9/1947 | Bushko . | |
| 2,966,697 | 1/1961 | Mintz . | |
| 3,559,232 | 2/1971 | Crane . | |
| 3,629,900 | 12/1971 | Beerli, Jr. . | |
| 5,104,161 | 4/1992 | Kautt | 16/330 |
| 5,125,131 | 6/1992 | Leblanc | 16/330 |
| 5,408,726 | 4/1995 | Kent . | |

FOREIGN PATENT DOCUMENTS

| | | | |
|---|---|---|---|
| 364243 | 8/1906 | France | 16/330 |
| 948742 | 1/1949 | France | 16/330 |
| 843071 | 7/1952 | Germany | 16/330 |

*Primary Examiner*—Chuck Mah
*Attorney, Agent, or Firm*—Oliff & Berridge, PLC

[57] ABSTRACT

A locking device is provided for pivotally connecting a closure to a support and locking the closure in an open position relative to the support. The locking device is locked in an open position by a first ratchet member attached to the closure and a second ratchet member attached to the support, the ratchet members being biased into engagement by at least one spring. A mechanism is provided to disengage the ratchet members and to hold the first and second ratchet members in a disengaged position so that the closure may be pivoted to a closed position.

45 Claims, 12 Drawing Sheets

LOCKING DEVICE FOR LOCKING A CLOSURE IN AN OPEN POSITION

BACKGROUND OF THE INVENTION

1. Field of the Invention

This invention relates to a ratchet or wedge locking device for pivotally interconnecting a closure to a support (or frame member) and locking the closure in at least one open position relative to the support. More specifically, this invention relates to a ratchet locking device of a hinged closure which 1) permits the closure to pivot in one direction and locks the closure in a plurality of open positions when the ratchet locking device is engaged and 2) permits the closure to pivot in the opposite direction when the ratchet locking device is disengaged.

2. Description of Related Art

The Office of Vehicle Safety Standards has adopted new regulations relating to emergency door exits for school buses. Generally, the regulations require school buses to have emergency doors which, when opened, automatically lock in an open position regardless of the orientation of the bus. These regulations are intended to ensure that children can exit from school buses in the event of an emergency through emergency doors.

Specifically, these regulations will require that school bus emergency doors be equipped with a device that (1) locks the doors in an open position past the point at which the door is perpendicular to the bus body, regardless of the bus orientation; (2) bears the weight of the door; and (3) provides a mechanism for releasing the door from its locked, open position and thus, allows the door to close. Accordingly, there is obviously a need for a locking device that meets these standards.

Furthermore, in emergency situations, children may not be able to push a heavy emergency bus door over 90° at one time, especially if the bus is laying on its side, an obstruction prevents the door from opening that widely, or the bus is in water. Therefore, preferably, the locking device should be capable of locking the door open in several positions less than 90° from the closed position. As a result, there is a need for a closure locking device which will lock a closure in various open positions.

Such a locking device optimally should include a releasing mechanism so that the locking function of the locking device can be released to allow the closure to close. By allowing the closure to close, the releasing mechanism allows the bus to be safely operated (with the emergency door closed) after activation of the emergency door.

In addition, the locking device should include a resetting mechanism which, after the closure has been opened and reclosed, automatically resets the locking device so that it is ready to lock the closure in the open position upon the next opening of the closure.

Examples of locking hinges which lock a door in an open position and prevent it from closing until being released are disclosed in U.S. Pat. Nos. 294,746 issued on Mar. 4, 1884 to Straup et al.; 917,768 issued on Apr. 13, 1909 to Jordan; 1,060,641 issued on May 6, 1913 to Sladden; 1,183,596 issued on May 16, 1916 to Sachse; 1,489,679 issued on Apr. 8, 1924 to Thornton; 2,966,697 issued on Jan. 3, 1961 to Mintz; 2,146,460 issued on Feb. 7, 1939 to Beeler; 3,559,232 issued on Feb. 2, 1971 to Crane; and 3,629,900 issued on Dec. 28, 1971 to Beerli, Jr.

However, these prior locking hinges have several disadvantages. Many of these locking hinges do not automatically lock the door in an open position. Additionally, many of these hinges can only be used in connection with certain type of doors. Furthermore, these hinges do not always provide the support and strength needed in emergency situations in application such as school buses. Finally, many of the prior locking hinges have complicated release mechanism which have many parts and are hard manufacture.

Examples of hinges which hold a door in an open position, but do not lock it in an open position are disclosed in U.S. Pat. Nos. 769,035 issued on Aug. 30, 1904 to Walter; 975,097 issued on Nov. 8, 1910 to Wright; 1,125,265 issued on Jan. 19, 1915 to Carter; 1,429,416 issued on Sep. 19, 1922 to Fade; 1,440,713 issued on Jan. 2, 1923 to Ausbourne; 1,465,912 issued on Aug. 21, 1923 to Jensen; 1,946,837 issued on Feb. 13, 1934 to Clayton; 2,097,651 issued on Nov. 2, 1937 to Stangeland; and 2,427,384 issued on Sep. 16, 1947 to Bushko.

U.S. Pat. No. 5,408,726 discloses a locking device for locking a closure in an open position and is designed to be retrofitted to an existing hinge. The present invention is an improvement over the locking devices disclosed by this patent.

In view of the above, it is apparent that a need exists for a locking device that automatically locks a door in several open positions, can be easily released from any of the locked open positions and can be installed on newly manufactured vehicles in the place of a regular hinge or can be retrofitted to existing vehicles. This invention addresses these needs in the art, along with other needs which will become apparent to those skilled in the art once given this disclosure.

SUMMARY OF THE INVENTION

This invention provides a ratchet or wedge locking device for pivotally connecting a closure to a support and having the capability of locking the closure in at least one open position relative to the support. The locking device includes a locking assembly and a releasing assembly. The locking assembly includes a first ratchet member fixedly coupled to the closure, a second ratchet member coupled to the support, and a biasing mechanism or spring for biasing the first and second ratchet members into engagement with each other. The first and second ratchet members have compatible teeth for limiting the pivotal movement of the closure to a first direction and locking the closure in an open position when the ratchet members are engaged. The releasing assembly disengages the first and second ratchet members, thereby allowing the closure to close.

In some embodiments of this invention, the locking device further includes a closure-side housing member and a support-side housing member. The closure-side housing member is fixedly coupled to the closure for movement with the closure, and the support-side housing member is fixedly coupled to the support. The locking mechanism connects the closure-side housing member to the support-side housing member about an axis for pivoting the closure-side housing member about the axis to open and close the closure relative to the support.

In other embodiments of this invention, the releasing assembly includes a pivot pin located along the pivotal axis of the locking device. The pivot pin is coupled to the second ratchet member such that, when the pivot pin is moved vertically, the second ratchet member also moves vertically and disengages the first ratchet member. The ratchet members are maintained in the disengaged position by a cam assembly. The cam assembly includes a separator cam fixedly attached to the pivot pin and a cam pin fixedly attached to the support-side housing member. The cam pin engages a surface of the separator cam to maintain the ratchet members in the disengaged position.

In other embodiments, the release mechanism is operated automatically through the use of a solenoid, which, when activated, disengages the second ratchet member from the first ratchet member and allows the closure to close.

In further embodiments, the locking device includes an automatic resetting assembly which causes the first and second ratchet members to re-engage when the closure reaches the closed position. The resetting assembly includes a roll pin fixedly attached to the pivot pin and a vertical surface fixedly attached to the closure-side housing member. When the closure is rotated about the axis to the closed position, the vertical surface contacts the roll pin and pushes the roll pin (and the attached pivot pin) in a direction which forces the cam surface of the separator cam (which is attached to the pivot pin) to move relative to the cam pin. This movement of the cam pin within the cam surface, along with spring force, causes the ratchet members to re-engage.

In yet further embodiments, the closure-side housing member is a first leaf of a hinge and the support-side housing member is a second leaf of a hinge.

The locking devices according to this invention have many advantages over prior locking devices.

One advantage of the locking devices according to this invention is that the devices automatically lock the closure in several open positions.

Another advantage of the locking devices according to this invention is that the devices are easily releasable, either manually or automatically.

Another advantage of some embodiments of the locking devices according to this invention is that the devices automatically reset the ratchet members to the engaged position when the closure is moved to the closed position.

A further advantage of the locking devices according to this invention is that the devices have relatively few parts and thus, are easy to manufacture and assemble.

Other advantages and salient features of the locking devices according to this invention will become apparent from the disclosure. Several embodiments of this invention will be described with respect to the drawings.

BRIEF DESCRIPTION OF THE DRAWINGS

Referring to the drawings which form a part of this disclosure.

DETAILED DESCRIPTION OF PREFERRED EMBODIMENTS

Figure 1:
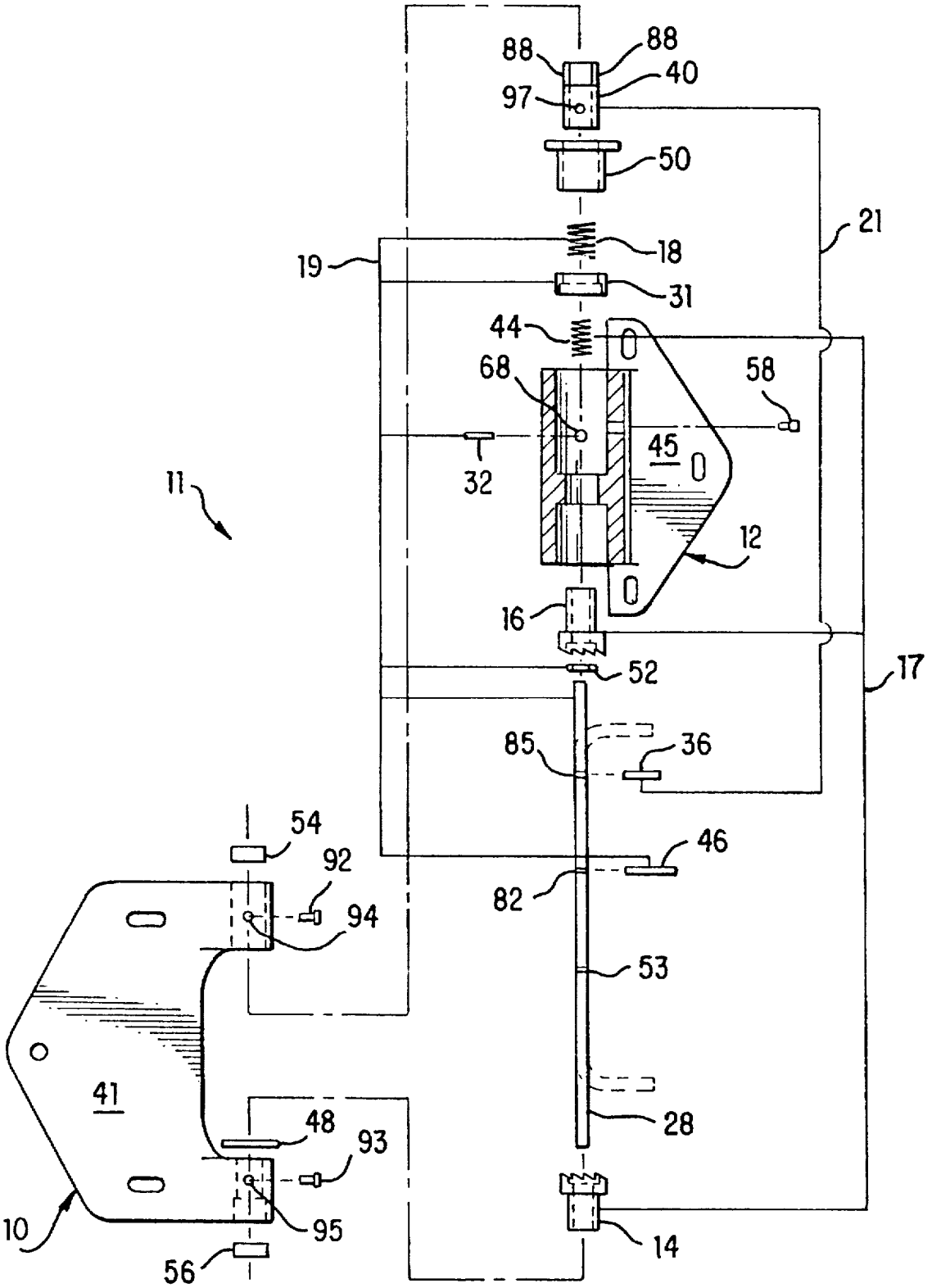
FIG. 1 is an exploded view of a first embodiment of a ratchet or wedge locking device in accordance with the present invention.

Referring to the Figures, a ratchet or wedge locking device, wedge locking device 11, for locking a closure (such as closure 13) in at least one open position relative to a support (such as support 15) according to this invention is illustrated.

Locking device 11 may be used in almost any environment which includes a pivotable closure and an adjacent support member, including doors, windows or any other type of hinged closures.

Locking device 11 has particular application for emergency doors of buses (including school buses), doors of aircraft, military vehicles, automobiles, tractor trailers and other vehicles, and gates.

Locking device 11 includes closure-side housing member 10 for attaching locking device 11 to closure 13, support-side housing member 12 for attaching locking device 11 to support 15, pivot pin 28, locking assembly 17 for locking locking device 11 in various open positions, releasing assembly 19 for releasing locking device 11 from a locked position, and resetting assembly 21 for resetting locking assembly 17. Preferably, locking device 11 is formed of metal but alternatively may be made of any material that meets the strength requirements.

Figure 9:
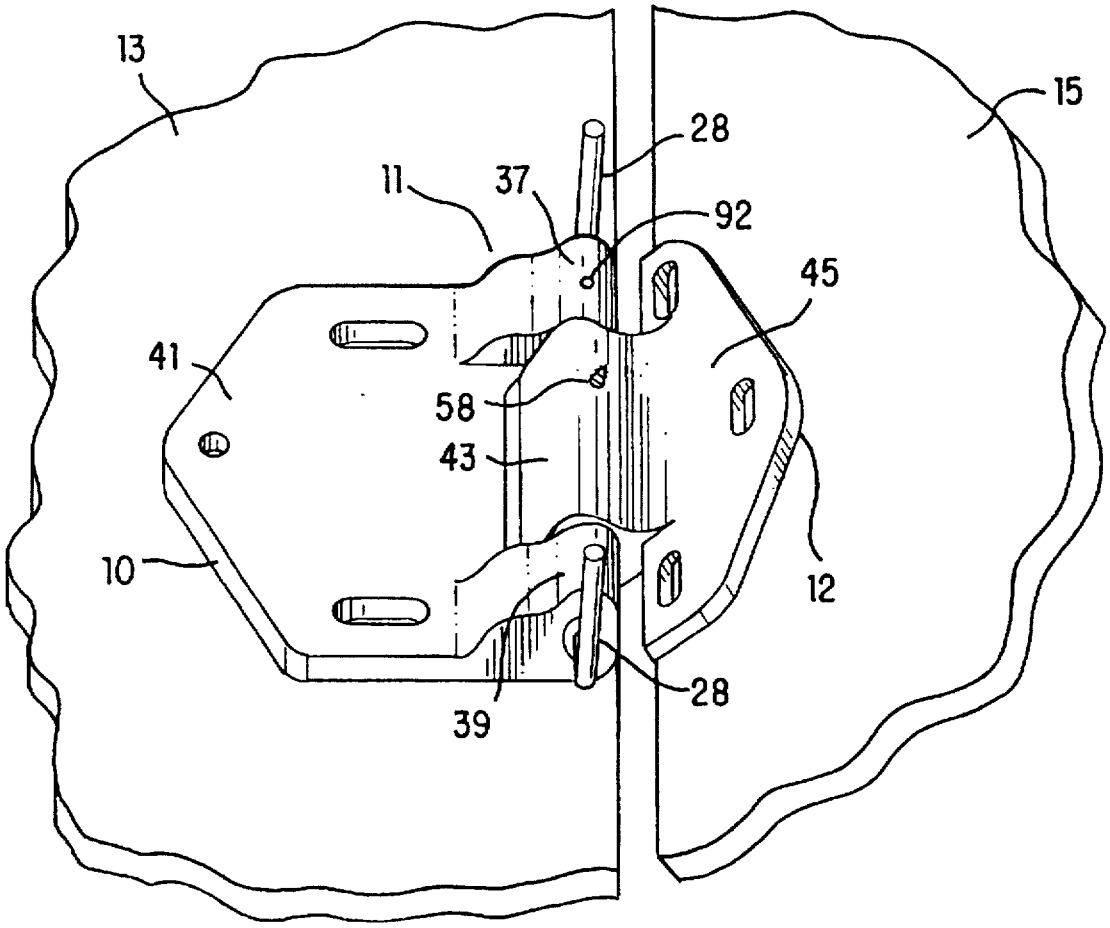
FIG. 9 is a perspective view of the locking device illustrated in FIGS. 1–8 in a partially open position.
Figure 12A:
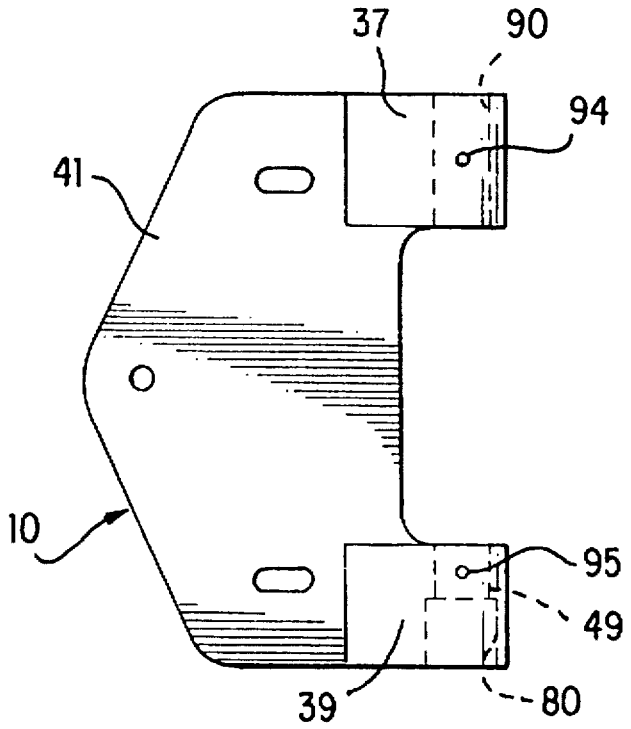
FIG. 12A is a side view of the closure-side housing member of the locking device illustrated in FIGS. 1–11.
Figure 12B:
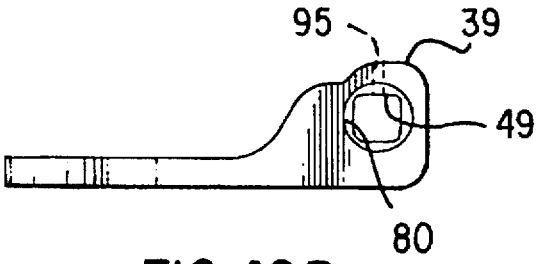
FIG. 12B is a bottom view of the closure-side housing member of the locking device illustrated in FIGS. 1–11.

In the preferred embodiment illustrated by the Figures, closure-side housing member 10 and support-side housing member 12 function as hinge leaves around central axis 1. As shown in FIGS. 9, 12A and 12B, closure-side housing member 10 includes first and second coaxial substantially cylindrical portions 37, 39 attached to flat portion 41. Flat portion 41 is designed to be attached to closure 13. Substantially cylindrical portion 39 includes substantially square recess 49 and cylindrical recess 80. (See FIGS. 12A and 12B) . Substantially square recess 49 and cylindrical recess 80 form a continuous passageway through cylindrical portion 39 along the longitudinal axis of cylindrical portion 39. Cylindrical portion 37 includes passageway 90 which passes through cylindrical portion 37 along the longitudinal axis of cylindrical portion 37.

Figure 13A:
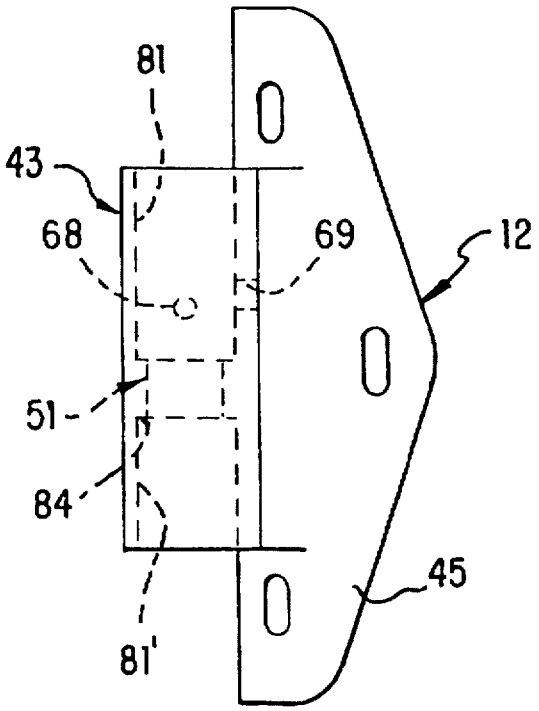
FIG. 13A is a side view of the support-side housing member of the locking device illustrated in FIGS. 1–12.
Figure 13B:
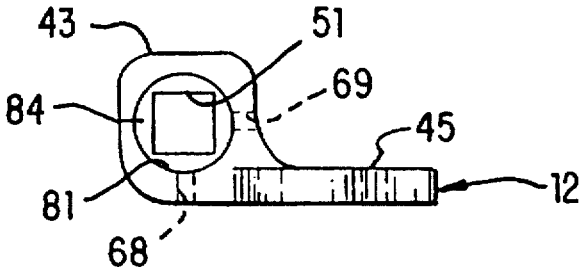
FIG. 13B is a bottom view of the support-side housing member of the locking device illustrated in FIGS. 1–12.

As shown in FIGS. 9, 13A and 13B, support-side housing member 12 includes substantially cylindrical portion 43 attached to flat portion 45. Flat portion 45 is designed to be fixedly attachable to support 15. Substantially cylindrical portion 43 includes substantially square recess 51, cylindrical recesses 81, 81' cam pin fixing hole 68 and grease fitting hole 69 (See FIGS. 13A and 13B) . Substantially square recess 51 and cylindrical recess 81, 81' form a continuous passageway through substantially cylindrical portion 43 along the longitudinal axis of substantially cylindrical portion 43. Substantially square recess 51 is located between cylindrical recesses 81, 81'. Cylindrical recess 81' is located at the end of substantially cylindrical portion 43 which is adjacent to second substantially cylindrical portion 39 of closure-side housing member 10. Edge 84 is created at the interface of substantially square recess 51 and cylindrical recess 81' because of the different cross-sectional areas and shapes of substantially square recess 51 and cylindrical recess 81'. The depth of cylindrical recess 81' (i.e., length of cylindrical recess 81' in the axial direction) must be long enough to allow assembly of locking device 11. Specifically, the depth of cylindrical recess 81' must be long enough to completely contain toothed portion 29 of second ratchet member 16 and the entire length of first ratchet member 14 so that both ratchet members 14, 16 can be pushed up into cylindrical recess 81' while substantially cylindrical portion 43 is aligned with substantially cylindrical portions 37, 39 of closure-side housing member 10 during assembly (discussed below).

When assembled, first and second substantially cylindrical portions 37, 39 of closure-side housing member 10 and substantially cylindrical portion 43 of support-side housing member 12 are in axial alignment with each other.

Figure 7A:
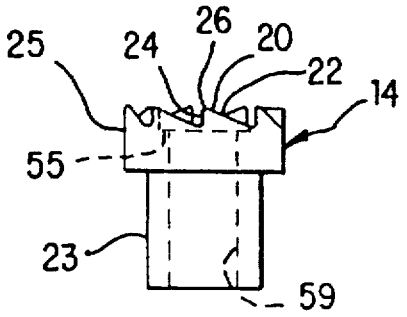
FIG. 7A is a side elevational view of the first ratchet member of the locking device illustrated in FIGS. 1–5.
Figure 7B:
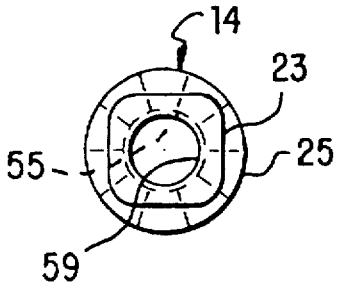
FIG. 7B is a bottom view of the first ratchet member of the locking device illustrated in FIGS. 1–5.

Locking assembly 17 includes first ratchet member 14, second ratchet member 16 and second spring 44. As shown in FIGS. 7A and 7B, first ratchet member 14 includes substantially square portion 23, toothed portion 25 and cylindrical hole 59. Substantially square portion 23 has a substantially square cross-section. Cylindrical hole 59 extends through first ratchet member 14 along its longitudinal axis. Toothed portion 25 includes teeth 20 and has a circular outer circumference. The interior surfaces of teeth 20 form recess 55. Recess 55 has a larger diameter than cylindrical hole 59.

Figure 6A:
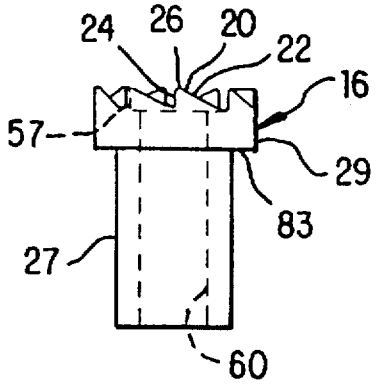
FIG. 6A is a side elevational view of the second ratchet member of the locking device illustrated in FIGS. 1–5.
Figure 6B:
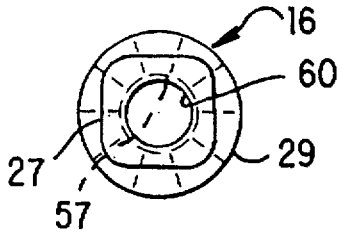
FIG. 6B is a top view of the second ratchet member of the locking device illustrated in FIGS. 1–5.

As shown in FIGS. 6A and 6B, second ratchet member 16 includes substantially square portion 27, toothed portion 29 and cylindrical hole 60. Substantially square portion 27 has a substantially square cross-section. Cylindrical hole 60 extends through second ratchet member 16 along its longitudinal axis. Toothed portion 29 includes teeth 20 and has a circular outer circumference. Upper face 83 of toothed portion 29 is the surface of toothed portion 29 opposite teeth 20 which is created because the cross-section of toothed portion 29 has a greater area and is of a different shape than the cross-section of substantially square portion 27. The interior surfaces of teeth 20 form recess 57. Recess 57 has a larger diameter then cylindrical hole 60.

First ratchet member 14 is coupled to closure-side housing member 10 and second ratchet member 16 is coupled to support-side housing member 12. This relation of ratchet members to housing members is illustrative only and it should be noted that the relation can be reversed.

In the preferred embodiment illustrated in the Figures, first ratchet member 14 is contained partially within second substantially cylindrical portion 39 of closure-side housing member 10 and partially within substantially cylindrical portion 43 of support-side housing member 12. First ratchet member 14 is fixedly coupled to closure-side housing member 10 such that it cannot move relative to closure-side housing member 10 in any direction. Specifically, substantially square portion 23 of first ratchet member 14 fits into substantially square recess 49 in second substantially cylindrical portion 39 of closure-side housing member 10. Substantially square portion 23 of first ratchet member 14 is fixedly attached to substantially cylindrical portion 39, and held in position in substantially square recess 49, by dog-point set screw 93, which passes through threaded hole 95 in substantially cylindrical portion 39. Toothed portion 25 is circular in cross section and is rotatably received within cylindrical recess 81' of substantially cylindrical portion 43 of support-side housing member 12.

Second ratchet member 16 is contained completely within and coupled to substantially cylindrical portion 43 of support-side housing member 12. Specifically, substantially square portion 27 of second ratchet member 16 is received in substantially square recess 51 in substantially cylindrical portion 43 of support-side housing member 12 such that substantially square portion 27 can slide axially relative to substantially square recess 51 (and thus second ratchet member 16 can slide axially relative to support-side housing member 12 along central axis 1) but can not rotate relative to substantially square recess 51. Substantially square portion 27 must be of sufficient length in the axial direction to always engage substantially square recess 51.

Toothed portion 29 is circular in cross section and is received in cylindrical recess 81' of substantially cylindrical portion 43 of support-side housing member 12. The diameter of toothed portion 29 of second ratchet member 16 is smaller than the diameter of toothed portion 25 of first ratchet member 14 by, for example, 0.025 inches to permit axial movement of second ratchet member 16 even when closure 13 is not precisely aligned with support 15. Moreover, since toothed portion 29 is smaller in diameter than toothed portion 25, toothed portion 25 and first ratchet member 14 will bear any force exerted on locking device 11, such as the weight of closure 13.

Stated differently, often closure 13 will not be precisely aligned with support 15, such that the axis of cylindrical portion 43 of support-side housing member 12 may not be exactly in line with the axis of cylindrical portions 37, 39 of closure-side housing member 10 or the axis of rotation of closure 13 may not precisely align with the axis of locking device 11. Since toothed portion 29 is smaller in diameter than toothed portion 25, second ratchet member 16 will still freely move axially in cylindrical recess 81' even if the axes of cylindrical portions 37, 39, 43 are not in precise alignment or if the axis of rotation of closure 13 does not precisely match the axis of rotation of locking device 11. Further, toothed portion 25 (and thus first ratchet member 14) will bear any force exerted on locking device 11.

Teeth 20 of first ratchet member 14 and second ratchet member 16 are compatible (see FIGS. 6A and 7A) and have first ramping surface 22, second stopping surface 24 and third flat surface 26. In another embodiment, teeth 20 of first ratchet member 14 and second ratchet member 16 only comprise ramping surface 22 and stopping surface 24 which intersect and form an edge. In the embodiment in the Figures, third flat surface 26 is provided so as to prevent wear breakage of teeth 20.

Figure 2:
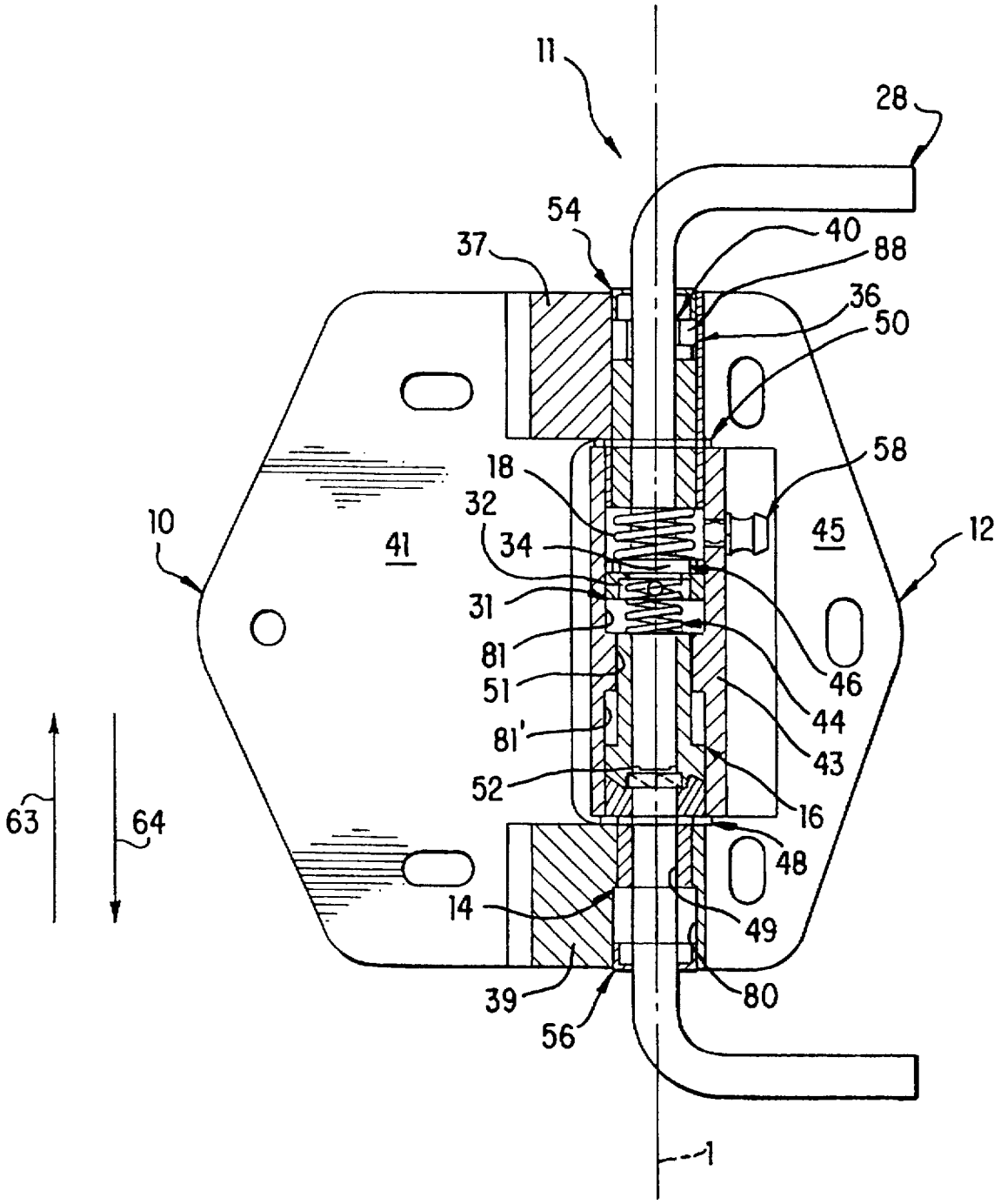
FIG. 2 is a front elevational view of the locking device illustrated in FIG. 1, having the housings broken away for clarity and showing the ratchet members engaged.
Figure 3:
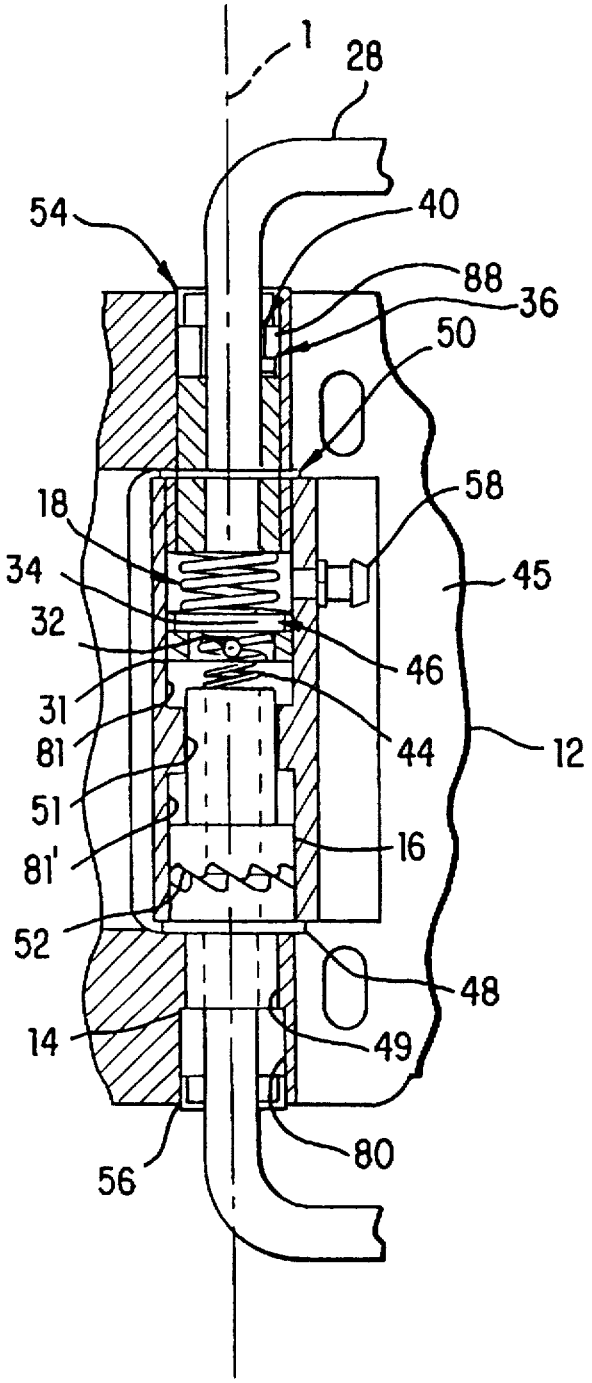
FIG. 3 is a partial front elevational view of the locking device illustrated in FIGS. 1 and 2, showing the movement of the second ratchet member as the locking device is pivoted open.
Figure 10:
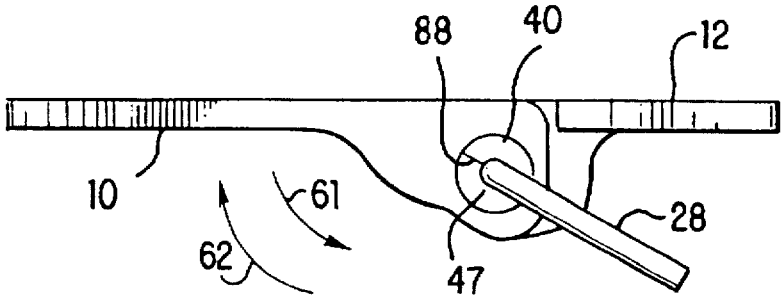
FIG. 10 is a top view of the locking device illustrated in FIGS. 1–9 in the closed position.

When teeth 20 of first and second ratchet members 14, 16 are engaged, movement of closure-side housing member 10 is limited to pivotal movement in first direction 61 while pivotal movement in second direction 62 is prevented (See FIGS. 1, 2 and 10). Second direction 62 is the opposite direction from first direction 61. In the Figures, first direction 61 and second direction 62 (and third direction 63 and fourth direction 64, described below) are relative to support-side housing member 12.

Specifically, if one attempts to move or rotate closure-side housing member 10 in second direction 62 when teeth 20 of ratchet members 14, 16 are engaged, second stopping surfaces 24 of teeth 20 of first ratchet member 14 come in contact with second stopping surfaces 24 of teeth 20 of second ratchet member 16. Since the attempted rotational force is substantially perpendicular to stopping surfaces 24, rotation in second direction 62 is resisted by the interface of adjacent stopping surfaces 24 (See FIG. 2). Therefore, when teeth 20 of ratchet members 14, 16 are engaging, stopping surfaces 24 prevent closure-side housing member 10 from rotating in second direction 62.

In contrast, if closure-side housing member 10 is rotated in first direction 61 when teeth 20 of ratchet members 14, 16 are engaged, ramping surfaces 22 of teeth 20 of first ratchet member 14 come in contact with ramping surfaces 22 of teeth 20 of second ratchet member 16. If this rotational force is greater in the vertical direction than the force of spring 44 (described below), closure-side housing member 10 (and thus first ratchet member 14 since it is fixedly attached to closure-side housing member 10) is rotated in first direction 61. This rotational movement of first ratchet members 14 causes second ratchet member 16 which cannot rotate relative to support-side housing member 12, to move in third direction 63 (perpendicular to directions 61 and 62, see FIG. 2) due to the movement of ramping surfaces 22 of teeth 20 of second ratchet member 16 along ramping surfaces 22 of teeth 20 of first ratchet member 14.

Ratchet members 14, 16 are positioned relative to one another such that teeth 20 of ratchet members 14, 16 are offset when closure 13 is fully closed. Stated differently, when closure 13 is closed, teeth 20 of ratchet members 14, 16 are not fully engaged. Rather, teeth 20 of second ratchet member 16 are offset from teeth 20 of first ratchet member 14. This permits flat portion 41 of closure-side housing member 10 to rotate more than 180 degrees from flat portion 45 of support-side housing member 12 in case closure 13 is not precisely aligned with support 15. Further, this permits closure 13 to be locked in an open position before ratchet member 14 has rotated a whole tooth. For example, if ratchet members 14, 16 have 10 teeth each, spaced at 36 degrees, since ratchet members 14, 16 are offset, the first locked open position will be less than 36 degrees.

In a preferred embodiment, the first locked open position (in which ratchet member 14,16 are fully engaged) when closure side housing member 10 is rotated in first direction 61 is 21 degrees from the plane of support-side flat portion 45. This position allows sufficient space between the frame of a school bus emergency door and the emergency door itself for an average child to exit through the emergency door opening.

Second spring 44 is a coil spring which urges second ratchet member 16 toward first ratchet member 14 along central axis 1. Specifically, second spring 44 surrounds pivot pin 28 and extends between and engages separator cam 31 and second ratchet member 16.

When teeth 20 of first ratchet member 14 and second ratchet member 16 are engaged, closure-side housing member 10, as explained above, is limited to pivotal movement in first direction 61. Therefore, a means for disengaging first and second ratchet members 14, 16, releasing assembly 19, is provided so that closure-side housing member 10 may be pivotally moved in second direction 62.

In the preferred embodiment illustrated by the Figures, releasing assembly 19 includes separator cam 31, cam pin 32, pivot pin 28, dowel pin 46, retaining ring 52 and first spring 18.

Pivot pin 28 is an elongated rod and extends along the longitudinal axis of locking device 11 (central axis 1). Pivot pin 28 includes retaining ring groove 53, roll pin hole 85 and dowel pin hole 82, for purposes discussed below (See FIG. 1). Retaining ring groove 53 is a circumferential groove in the outer surface of pivot pin 28. Holes 85, 82 pass through pivot pin 28 perpendicular to its longitudinal axis. In a preferred embodiment, the ends of pivot pin 28 are covered by knobs for safety and ease of use.

Pivot pin 28 is slidably and rotatably received through cylindrical hole 59 of first ratchet member 14 such that pivot pin 28 can freely rotate and move axially within cylindrical hole 59 of first ratchet member 14. Pivot pin 28 is rotatably and slidably received within cylindrical hole 60 of second ratchet member 16 such that pivot pin 28 can freely rotate within cylindrical hole 60 of second ratchet member 16.

Retaining ring 52 is fixedly mounted in retaining ring groove 53 of pivot pin 28. Retaining ring 52 is a snap ring, i.e., retaining ring 52 can be expanded to slide onto pivot pin 28. Retaining ring 52 has an outer diameter which is less than the diameter of recess 57 but greater than the diameter of cylindrical hole 60 of second ratchet member 16. When locking device 11 is assembled, retaining ring 52 is positioned in recess 57 of second ratchet member 16. When pivot pin 28 is moved in third direction 63, retaining ring 52 abuts the shoulder formed by the intersection of recess 57 and cylindrical hole 60 (since cylindrical hole 60 has a smaller diameter than recess 57) and moves second ratchet member 16 in third direction 63.

Figure 8A:
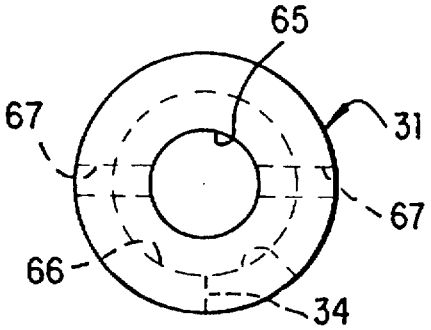
FIG. 8A is a top view of the separator cam of the locking device illustrated in FIGS. 1–5.
Figure 8B:
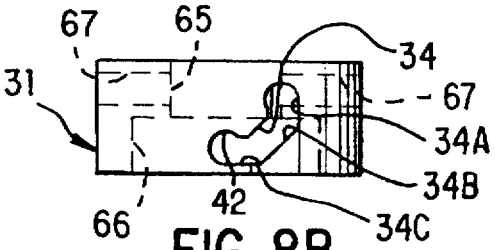
FIG. 8B is a side view of the separator cam of the locking device illustrated in FIGS. 1–5.

As shown in FIGS. 8A and 8B, separator cam 31 is a substantially cylindrical disk and includes cam surface 34, cylindrical hole 65, recess 66 and dowel pin holes 67. Cylindrical hole 65 and recess 66 extend through the center of separator cam 31 along its longitudinal axis and form a continuous passageway. Dowel pin holes 67 extend perpendicular to the axis of cylindrical hole 65 and recess 66. Cam surface 34 extends from the exterior of separator cam 31 toward cylindrical hole 65 and recess 66. As shown in FIG. 8B, cam surface 34 includes first flat portion 34A, second angled portion 34B and third flat portion 34C. First flat portion 34A is oriented vertically. Third flat portion 34C is oriented horizontally. Second angled portion 34B extends between and connects first flat portion 34A and third flat portion 34C.

Pivot pin 28 is received within cylindrical hole 65 in separator cam 31. Separator cam 31 is fixedly attached to pivot pin 28 by dowel pin 46 (i.e., dowel pin 46 passes through dowel pin hole 82 in pivot pin 28 and is press fitted into dowel pin holes 67) such that separator cam 31 moves simultaneously with pivot pin 28 in first, second, third and fourth directions 61, 62, 63, 64 whenever pivot pin 28 is moved in one or more of these directions.

First spring 18 surrounds pivot pin 28 and is located between hinge pin 40 (described below) and separator cam 31 such that first spring 18 urges separator cam 31 away from hinge pin 40. The purpose of first spring 18 is to force cam pin 32 from third flat portion 34C of cam surface 34 to first flat portion 34A of cam surface 34 when locking device 11 is reset by resetting assembly 21 (described below).

First spring 18 must be of sufficient stiffness relative to spring 44 such that first spring 18 compresses only insignificantly when second spring 44 is in maximum compression. In this regard, in a preferred embodiment, first spring 18 has a spring constant equal to 101 lbs./in. and second spring 44 has a spring constant equal to 49 lbs./in. Further, when ratchet members 14, 16 are engaged, second spring 44 must exert a force of at least 4 lbs. on second ratchet member 16 to prevent accidental disengagement of ratchet members 14, 16. In addition, when cam pin 32 contacts first flat portion 34*a* of cam surface 34, first spring 18 exerts a minimum force of 15 lbs. on separator cam 31 for the reasons discussed above.

Cam pin 32 is a dog-point set screw and is fixedly attached to support-side housing member 12 by screwing cam pin 32 into cam pin fixing hole 68 in support-side housing member 12. Cam pin 32 extends inwardly from substantially cylindrical portion 43 of support-side housing member 12 and slidably engages cam surface 34.

When cam pin 32 is in engagement with first flat portion 34A, movement of cam pin 32 is limited to third and fourth directions 63, 64 relative to cam surface 34 since first flat portion 34A is elongated in the vertical direction. This feature prevents accidental releasing (for example, due to a frozen or jammed assembly) of ratchet members 14, 16 (as explained below) since separator cam 31 can not be rotated without first moving pivot pin 28 in third direction 63 against the force of first spring 18. When cam pin 32 is in engagement with third flat portion 34C, movement of cam pin 32 is limited to first and second directions 61, 62 relative to cam surface 34C since third flat portion 34C is elongated in the horizontal direction. As stated, second angled portion 34B connects first and third flat portions 34A, 34C, such that cam pin 32 can move within cam surface 34 from first flat portion 34A to third flat portion 34C and vice versa.

In a preferred embodiment, third flat portion 34C of cam surface 34 comprises detent 42 in which cam pin 32 rests when first and second ratchet members are disengaged (See FIG. 8B).

Releasing assembly 19 functions as follows. When ratchet members 14, 16 are engaged, cam pin 32 is in first flat portion 34A of cam surface 34. Specifically, cam pin 32 is in the uppermost portion of first flat portion 34A. To release or disengage ratchet members 14 and 16, pivot pin 28 is first moved in third direction 63 against the force of first spring 18 and then in first direction 61. Since separator cam 31 is fixedly attached to pivot pin 28, this moves separator cam 31 (and cam surface 34) upward in third direction 63 and rotationally in first direction 61 relative to cam pin 32 such that cam pin 32 moves (relative to cam surface 34; in actuality cam pin 32 does not move) downward through first portion 34A, through second angled portion 34B and into third flat portion 34C.

Figure 4:
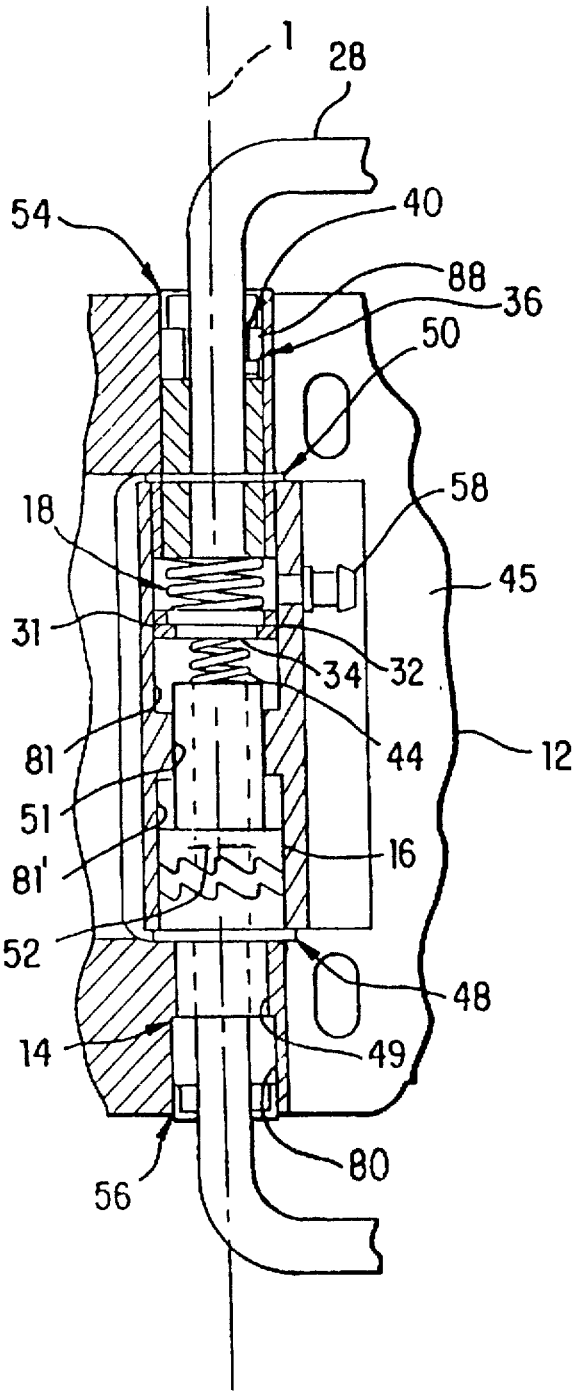
FIG. 4 is a partial front elevational view of the locking device illustrated in FIGS. 1–3, showing the ratchet members disengaged.

The vertical distance between (1) the upper-most position of cam pin 32 in first flat portion 34A and (2) third flat portion 34C is greater than the height of teeth 20 of ratchet members 14, 16 so that when cam pin 32 is in third flat portion 34C, teeth 20 of ratchet members 14, 16 are completely disengaged (see FIG. 4).

Second ratchet member 16 is held in the disengaged position from first ratchet member 14 (i.e., teeth 22 of ratchet members 14, 16 are disengaged) as follows. Separator cam 31 is urged by first spring 18 in fourth direction 64 but is prevented from moving in fourth direction 64 since cam pin 32 is in third flat portion 34C, specifically, cam pin 32 is in detent 42 of third flat portion 34C.

When first ratchet member 14 and second ratchet member 16 are in the disengaged position, closure-side housing member 10 is free to pivot in first and second directions 61, 62 about central axis 1. In the case where locking device 11 is attached to a door and a frame, when first ratchet member 14 and second ratchet member 16 are in the disengaged position, opening and closing of the door is not limited by locking assembly 17.

Figure 11A:
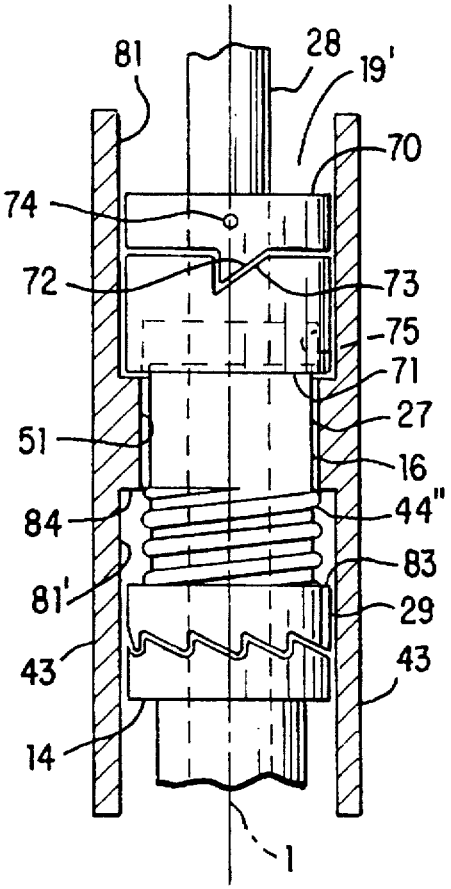
FIG. 11A is a side view of a second embodiment of the releasing assembly for the locking device illustrated in FIGS. 1–10, showing the releasing mechanism in the engaged position.
Figure 11B:
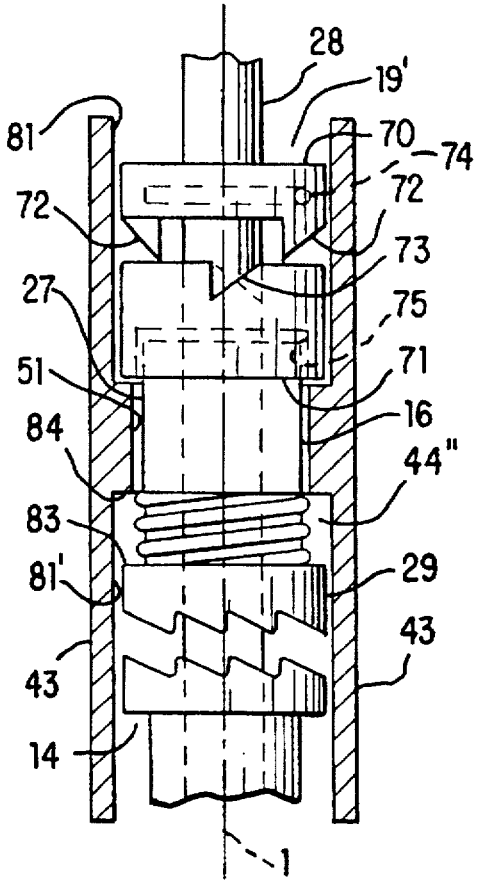
FIG. 11B is a side view of the embodiment of the releasing assembly illustrated in FIG. 11A, showing the releasing assembly in the disengaged position.
Figure 11C:
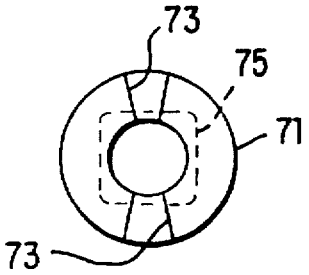
FIG. 11C is a top view of the notched collar of the second embodiment of the releasing assembly shown in FIGS. 11A and 11B.

Another embodiment of a releasing assembly in accordance with this invention is releasing assembly 19' (see FIGS. 11A, 11B and 11C). Releasing assembly 19' includes toothed collar 70, notched collar 71 and spring 44" instead of separator cam 31, cam pin 32 and first spring 18.

Toothed collar 70 is a cylindrical collar having flat top and bottom surfaces except for two teeth 72 (located 180 degrees from each other) extending downward from the bottom surface. Toothed collar 70 is fixedly attached to pivot pin 28 by pin 74.

Notched collar 71 is a substantially cylindrical collar having a flat top surface except for two notches 73 (located 180 degrees from each other) recessed into the top surface. Notched collar 71 is fixedly attached to cylindrical recess 81 of substantially cylindrical portion 43 of support-side housing member 12. Notched collar 71 has substantially square axial hole 75 in its bottom surface which slidably receives substantially square portion 27 of the second ratchet member 16, as discussed below. Teeth 72 fit into notches 73 to engage toothed collar 70 with notched collar 71.

Spring 44" fits around substantially square portion 27 of second ratchet member 16 and bears on upper face 83 of toothed portion 29 of second ratchet member 16 and edge 84 of substantially square recess 51 in substantially cylindrical portion 43 of support-side housing member 12. As pivot pin 28 is moved in third direction 63, toothed collar 70 is moved in third direction 63 disengaging teeth 72 from notches 73, and second ratchet member 16 is disengaged from first ratchet member 14 against the force of spring 44". While teeth 72 and notches 73 are disengaged, pivot pin 28 is rotated in either first direction 61 or second direction 62 to rotate teeth 72 out of alignment with notches 73. Pivot pin 28 can then be released and (under the force of spring 44") teeth 72 will contact notched collar 71 in locations other than notches 73, thereby holding second ratchet member 16 in a disengaged position.

Cylindrical recess 81' in support-side housing member 12 is made sufficiently deep to receive spring 44", cylindrical portion 29 of second ratchet member 16 and all of first ratchet member 14 during assembly.

In an alternate embodiment, spring 44" is located between the end of substantially square portion 27 of second ratchet member 16 and notched collar 71 such that one end of spring 44" contacts the end of substantially square portion 27 and the other end of spring 44" contacts the bottom surface of notched collar 71.

Figure 14:
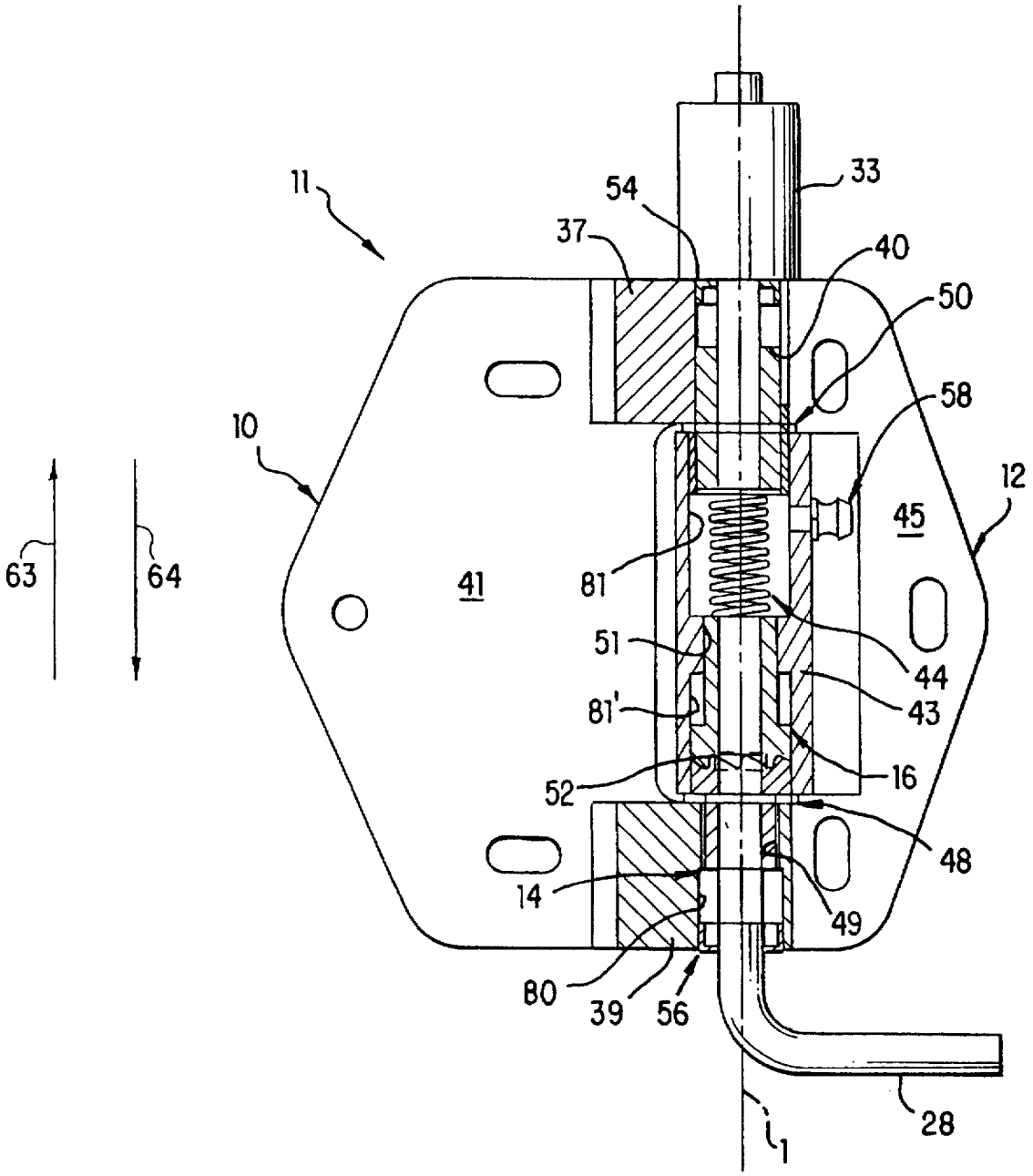
FIG. 14 is a side view of an embodiment of this invention using a solenoid as part of the releasing assembly.

In yet another embodiment, releasing assembly 19 is solenoid 33 (See FIG. 14). Solenoid 33 moves pivot pin 28 in third direction 63 against the force of spring 44' to disengage first and second ratchet members 14, 16 when solenoid 33 is activated. As described above, disengaging first and second ratchet members 14, 16 allows closure-side housing member 10 to pivot in second direction 62 and close the closure.

An advantage of the invention is that releasing assemblies 19 and 19' can operate without housing members 10, 12 moving relative to each other. This is an important advantage because, in an emergency situation, it may be important to be able to close the closure but it may not be possible to move the closure in the opening direction.

Resetting assembly 21 includes roll pin 36 and hinge pin 40. Roll pin 36 is a cylindrical pin which is fixedly coupled to pivot pin 28 in roll pin hole 85 (see FIG. 1) and is perpendicular to the axis of pivot pin 28. One end of roll pin 36 protrudes radially from pivot pin 28 (See FIG. 2).

Figure 15A:
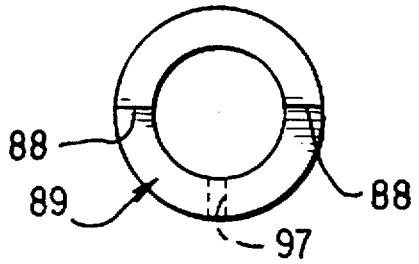
FIG. 15A is a top view of the hinge pin of the locking device illustrated in FIGS. 1–13.
Figure 15B:
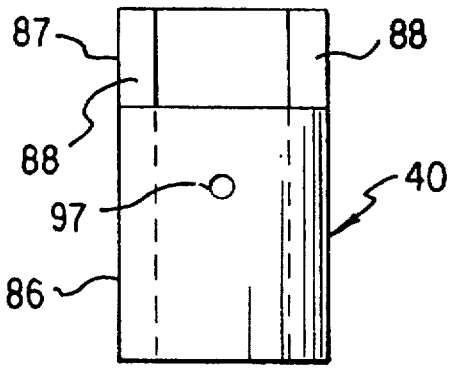
FIG. 15B is a side view of the hinge pin of the locking device illustrated in FIGS. 1–13.

Hinge pin 40 is received within and is fixedly attached to first substantially cylindrical portion 37 of closure-side housing member 10 by dog-point set screw 92, which engages threaded hole 94 in substantially cylindrical portion 37 and orientation hole 97 in hinge pin 40. Therefore, hinge pin 40 moves with closure-side housing member 10. Hinge pin 40 includes a lower cylindrical portion 86 and a top portion 87 (see FIGS. 15A and 15B). A portion of lower cylindrical portion 86 is rotatably received within thrust bushing 50 (described below). Top portion 87 has vertical surfaces 88, with an opening 89 formed between vertical surfaces 88. When locking device 11 is assembled, roll pin 36 is received in opening 89.

Resetting assembly 21 functions as follows. As closure-side housing member 10 is rotated in second direction 62, at a point prior to a position in which the closure would be closed, vertical surface 88 contacts roll pin 36. Continued rotation of closure-side housing member 10 in second direction 62 forces roll pin 36 (and pivot pin 28) to move in second direction 62. Since separator cam 31 is also fixedly attached to pivot pin 28, this causes separator cam 31 to also rotate in second direction 62. This forces cam pin 32 to move (relative to separator cam 31) from third flat portion 34C of cam surface 34 through second angled portion 34B of cam surface 34 to first flat portion 34A of cam surface 34. Movement of cam pin 32 from third flat portion 34C to first flat portion 34A through second angled portion 34B causes pivot pin 28 to move in fourth direction 64 which in turn causes first and second ratchet members 14, 16 to re-engage.

The function of resetting assembly 21 is automatic since vertical surface 88 is located such that, every time closure-side housing member 10 is moved in second direction 62 to the point just prior to where closure-side flat portion 41 is on the same plane as support-side flat portion 45, vertical surface 88 of hinge pin 40 engages roll pin 36 and pushes roll pin 36 and thus pivot pin 28 in second direction 62.

Locking device 11 also includes grease seals 54, 56 and grease fitting 58 so that locking device 11 can be lubricated and will retain the lubrication. Grease seals 54, 56 are cup-shaped resilient members with axial through holes such that grease seals 54, 56 can slide over pivot pin 28 and fit into substantially cylindrical portions 37, 39 of closure-side housing member 10 (See FIG. 2).

Grease seals 54, 56 are provided to contain grease in the spaces of substantially cylindrical portions 37, 39, 43 of housing members 10, 12 and to protect the various assemblies from outside contaminants. Grease fitting 58 is provided in one of the housing members to facilitate filling interior spaces of the substantially cylindrical portions of the housing members with grease. The embodiment shown in the Figures provides grease fitting 58 mounted in grease fitting hole 69 in substantially cylindrical portion 43 of support-side housing member 12.

In addition, locking device 11 includes thrust washer 48 and thrust bushing 50. The purpose of thrust washer 48 and thrust bushing 50 is to facilitate rotation between substantially cylindrical portions 37, 39 and substantially cylindrical portion 43.

Thrust washer 48 is a flat, round washer which is placed between second substantially cylindrical portion 39 of closure-side housing member 10 and substantially cylindrical portion 43 of support-side housing member 12 (see FIG. 2). Thrust washer 48 has a round hole through its axial center for receiving substantially square portion 23 of first ratchet member 14.

Thrust bushing 50 fits in the other end of substantially cylindrical portion 43 of support-side housing member 12 such that a flange of thrust bushing 50 fits between substantially cylindrical portion 43 of support-side housing member 12 and first substantially cylindrical portion 37 of closure-side housing member 10.

Closure-side housing member 10, support-side housing member 12, locking assembly 17, releasing assembly 19 and resetting assembly 21 may be assembled as follows (see FIGS. 1 and 2).

Separator cam 31 is inserted into cylindrical recess 81 in substantially cylindrical portion 43 of support-side housing member 12. Thrust bushing 50 is pressed into cylindrical recess 81. Second spring 44 is inserted through cylindrical recess 81' in substantially cylindrical portion 43 and such that its upper end is received in recess 66 in separator cam 31. Second ratchet member 16 is inserted in cylindrical recess 81' such that substantially square portion 27 of second ratchet member 16 engages substantially square recess 51 in substantially cylindrical portion 43. Retaining ring 52 is placed in recess 57 of second ratchet member 16. First ratchet member 14 is inserted in cylindrical recess 81' such that teeth 20 of first and second ratchet members 14, 16 engage. Thrust washer 48 is placed over substantially square portion 23 of first ratchet member 14. First ratchet member 14 is then pushed inside cylindrical recess 81' so that the end of substantially square portion 23 of first ratchet member 14 is flush with thrust washer 48. Substantially cylindrical portion 43 of support-side housing member 12 is located between substantially cylindrical portions 37,39 of closure-side housing member 10 such that the central axes of substantially cylindrical portions 37, 43, 39 align.

Downward force is then exerted on separator cam 31 and transmitted through second spring 44 and second ratchet member 16 to press substantially square portion 23 of first ratchet member 14 into substantially square recess 49 in substantially cylindrical portion 39 of closure-side housing member 10. Dog-point set screw 93 is screwed into threaded hole 95 in substantially cylindrical portion 39 and fixedly attached to substantially square portion 23 of first ratchet member 14. This fixedly attaches first ratchet member 14 to closure-side housing member 10.

First spring 18 is inserted through passageway 90 of substantially cylindrical portion 37 and thrust bushing 50 and into contact with separator cam 31. Hinge pin 40 is pushed into passageway 90 of substantially cylindrical portion 37 and thrust bushing 50.

Roll pin 36 is pressed into roll pin hole 85 of pivot pin 28. Pivot pin 28 is inserted through hinge pin 40, first spring 18, separator cam 31, second spring 44, second ratchet member 16 and first ratchet member 14 until retaining ring groove 53 in pivot pin 28 engages retaining ring 52 (retaining ring 52 is located between ratchet members 14,16) . Pivot pin 28 may be a straight pin at this time, or the top portion may have already been bent as shown in the Figures. Dog-point set screw 92 is inserted into threaded hole 94 in substantially cylindrical portion 37 such that the point of dog-point set screw 92 enters orientation hole 97 in hinge pin 40.

Pivot pin 28 and separator cam 31 are positioned such that dowel pin holes 67 in separator cam 31, dowel pin hole 82 in pivot pin 28 and grease fitting hole 69 in substantially cylindrical portion 43 are in alignment. Dowel pin 46 is then pressed completely through grease fitting hole 69 and into dowel pin holes 67 in separator cam 31 and dowel pin hole 82 in pivot pin 28, thereby fixedly attaching separator cam 31 to pivot pin 28. Separator cam 31 is positioned so that cam surface 34 is in alignment with cam pin fixing hole 68 in substantially cylindrical portion 43. Cam pin 32 is then fixedly attached to cam pin fixing hole 68 in substantially cylindrical portion 43 such that cam pin 32 protrudes into cylindrical recess 81 in substantially cylindrical portion 43 and engages cam surface 34.

Both ends of pivot pin 28 (which now protrude beyond substantially cylindrical portions 37 and 39) are bent at a 90° angle (if the top portion has not already been bent). Grease seals 54,56 are pushed over the ends of pivot pin 28 and pressed into substantially cylindrical portions 37 and 39, respectively. Grease fitting 58 is threaded into grease fitting hole 69 in substantially cylindrical portion 43.

At this point locking device 11 is completely assembled and is filled with grease through grease fitting 58.

There are other methods which may be employed to assemble locking device 11. This method is intended to serve as an example of the possible methods.

When locking device 11 is assembled, pivot pin 28 extends axially along central axis 1 and passes through grease seal 54, hinge pin 40, first spring 18, separator cam 31, second spring 44, second ratchet member 16, retaining ring 52, first ratchet member 14 and grease seal 56.

Figure 5:
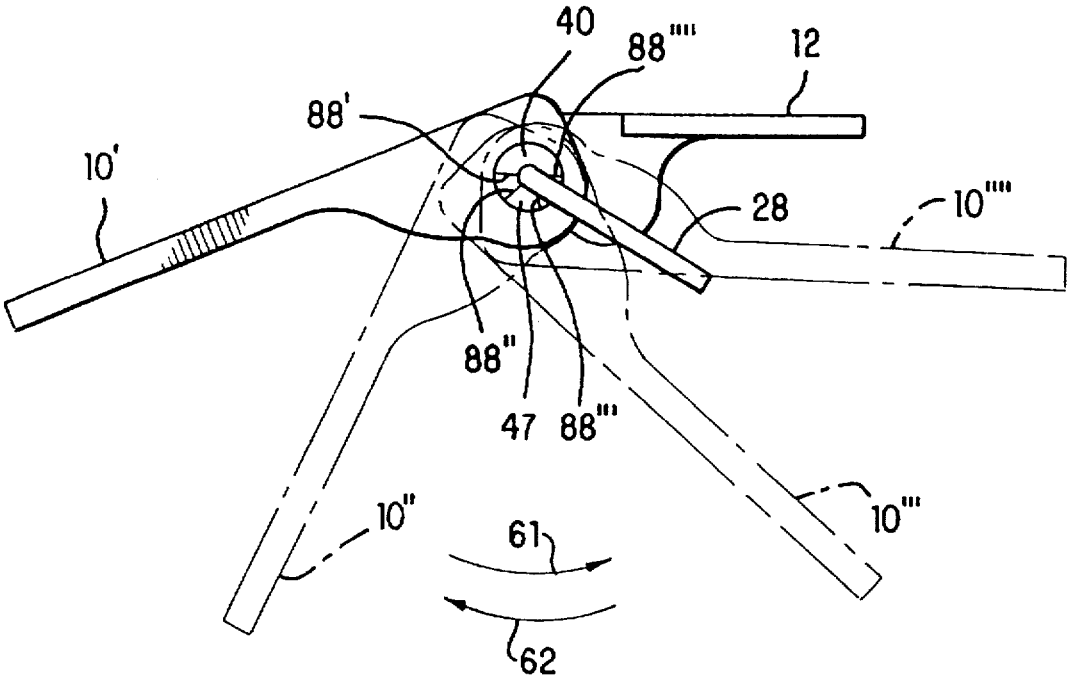
FIG. 5 is a top view of the locking device illustrated in FIGS. 1–4 illustrating various open positions of the locking device.

FIG. 5 illustrates various locked-open positions 10', 10", 10'", 10"" of closure-side housing member 10. The positions shown in FIG. 10 are representative only. Locking device 11 is not limited to these positions and can be designed to provide any desired locked-open positions. In this embodiment, locking device 11 is configured as a hinge and thus is made sufficiently strong to support the weight of the closure to which locking device 11 is mounted. In the embodiments in which locking device 11 functions as a hinge, hinge pin 40 and first ratchet member 14 perform the function of a conventional, one-piece hinge pin.

Although locking device 11 has been described in an embodiment that comprises a hinge, locking device 11 can be configured so as to be mountable to an existing hinge.

The invention has been described using embodiments based on locking device 11 being used to hold a closure in an open position. It is apparent that the invention can also be used to prevent movement of a closure in an opening direction and to hold the closure in a closed position and/or a number of partially open positions. An example of an application for this embodiment is a gate in a fence. Such a gate would be locked in the closed position by locking device 11 (releasable by releasing assembly 19) and could be locked in one of a number of partially open positions to allow a person to pass through the gate but prevent a large animal (such as a horse or a cow) from passing through. Locking device 11 could also eliminate the requirement of a separate latching device at the opening end of the gate. A spring mechanism may be provided to bias the gate in the closed direction.

Various modifications, improvements and other embodiments will become apparent to those skilled in the art once given this disclosure. Such modifications, improvements and other embodiments are considered to be within the scope of this invention as defined by the following claims.

What is claimed is:

1. A locking device for pivotally connecting a closure to a support and locking the closure in at least one open position relative to the support, wherein the closure pivots about an axis between a closed position and the at least one open position, said locking device comprising:

a closure-side housing member for fixedly coupling to the closure and a support-side housing member for fixedly coupling to the support;

locking means having a first ratchet member fixedly coupled to one of said housing members, a second ratchet member coupled to the other of said housing members and a biasing means for biasing the first and second ratchet members into engagement with each other, each of the first and second ratchet members having compatible teeth for limiting pivotal movement of the first ratchet member relative to the second ratchet member to a first direction and locking the closure in a set position when said first and second ratchet members are in engagement; and releasing means for disengaging the first and second ratchet members, thereby allowing the closure to pivot in a second direction to the closed position, the releasing means comprising:

a pivot pin received by said housing members and extending along the axis, the second ratchet member being coupled to the pivot pin for movement with the pivot pin in a third direction perpendicular to the first and second directions, thereby disengaging the second ratchet member from the first ratchet member when the pivot pin is moved in the third direction; and a cam assembly comprising a cam pin and a cam member having a cam surface;

wherein the cam pin is fixedly coupled to the other of said housing members, the cam member is fixedly coupled to the pivot pin, the cam surface comprises two portions which are spaced vertically, said cam pin engages the uppermost of said two portions when said first and second ratchet members are engaged and engages the lowermost of said two portions when the first and second ratchet members are disengaged.

2. The locking device as defined by claim 1, wherein;

said uppermost portion of said cam surface is a first flat portion, said lowermost portion of said cam surface is a third flat portion, said cam surface includes a second angled portion which extends between and connects the first and third flat portions, and said cam member is movable in the first, second and third directions and a fourth direction opposite to said third direction.

3. The locking device as defined by claim 1, wherein the biasing means comprises a spring.

4. The locking device as defined by claim 1, wherein a portion of one of the locking means and the releasing means is contained within said housing members.

5. The locking device as defined by claim 1, further comprising engaging means for re-engaging the first and second ratchet members when the closure pivots in the second direction to the closed position.

6. The locking device as defined by claim 5, wherein the engaging means comprises a second member fixedly coupled to the pivot pin and perpendicular to the axis of the pivot pin, and wall means affixed to said one of said housing members for engaging the second member when said one of said housing members is moved in said second direction to rotate the second member and pivot pin with said one of said housing members.

7. The locking device as defined by claim 6, wherein said rotation of said pivot pin in said second direction rotates said cam surface relative to said cam pin, thereby moving the pivot pin in the fourth direction and engaging the first and second ratchet members.

8. The locking device as defined by claim 6, wherein the wall means is a flat surface of a hinge pin.

9. The locking device as defined by claim 1, wherein the lowermost portion of the cam surface comprises a detent in which the cam pin rests when the first and second ratchet members are disengaged.

10. The locking device as defined by claim 1, wherein the closure-side housing member and the support-side housing member are hinge leaves and a hinge pin connects the closure-side housing member and support-side housing member in such a manner that the locking device is a hinge.

11. The locking device as defined by claim 10, wherein the locking device is sufficiently strong to support the weight of the closure to which the locking device is mounted.

12. The locking device as defined by claim 1, wherein the locking means and cam assembly are contained within said housing members.

13. The locking device as defined by claim 1, wherein when the closure is in the closed position, said ratchet members are engaged.

14. The locking device as defined by claim 13, wherein said uppermost portion of said cam surface is a first flat portion, said lowermost portion of said cam surface is a third flat portion, said cam surface includes a second angled portion which extends between and connects the first and third flat portions, and said cam member is movable in the first, second and third directions and a fourth direction opposite said third direction.

15. The locking device as defined by claim 14, wherein when the cam pin moves relative said cam surface from the lowermost of said two portions to the uppermost of said two portions, the first and second ratchet members are moved into engagement with each other.

16. The locking device as defined by claim 13, wherein the biasing means comprises a spring.

17. The locking device as defined by claim 13, wherein a portion of one of the locking means and the releasing means is contained within said housing members.

18. The locking device as defined by claim 13, further comprising engaging means for re-engaging the first and second ratchet members when the closure pivots in the first direction to the open position.

19. The locking device as defined by claim 18, wherein the engaging means comprises a second pin fixedly coupled to the pivot pin and perpendicular to the axis of the pivot pin, and wall means affixed to said one of said housing members for engaging the second pin when said one of said housing members is moved in said second direction to rotate the second pin and pivot pin with said one of said housing members.

20. The locking device as defined by claim 19, wherein said rotation of said pivot pin in said second direction rotates said cam surface relative to said cam pin, thereby moving the pivot pin in the fourth direction and engaging the first and second ratchet members.

21. The locking device as defined by claim 19, wherein the wall means is a flat surface of a hinge pin.

22. The locking device as defined by claim 13, wherein the lowermost portion of the cam surface comprises a detent in which the cam pin rests when the first and second ratchet members are disengaged.

23. The locking device as defined by claim 13, wherein the closure-side housing member and the support-side housing member are hinge leaves and a hinge pin connects the closure-side housing member and support-side housing member in such a manner that the locking device is a hinge.

24. The locking device as defined by claim 23, wherein the locking device is sufficiently strong to support the weight of the closure to which the locking device is mounted.

25. The locking device as defined by claim 13, wherein the locking means and cam assembly are contained within said housing members.

26. The locking device as defined by claim 13, wherein said first ratchet member comprises a cylindrical toothed portion, said second ratchet member comprises a cylindrical toothed portion and the support-side housing member comprises a cylindrical recess for receiving the cylindrical toothed portions of the first and second ratchet members, the cylindrical toothed portion of the second ratchet member having an outer diameter which is less than an outer diameter of the cylindrical toothed portion of the first ratchet member to permit axial movement between the cylindrical toothed portion of the second ratchet member and the cylindrical recess.

27. The locking device as defined by claim 1, wherein when the cam pin moves relative said cam surface from the lowermost of said two portions to the uppermost of said two portions, the first and second ratchet members are moved into engagement with each other.

28. The locking device as defined by claim 1, wherein the teeth of the first ratchet member are offset from the teeth of the second ratchet member when the closure is in the closed position such that the teeth of said ratchet members are not fully engaged when the closure is in the closed position.

29. The locking device as defined by claim 1, wherein said first ratchet member comprises a cylindrical toothed portion, said second ratchet member comprises a cylindrical toothed portion and the support-side housing member comprises a cylindrical recess for receiving the cylindrical toothed portions of the first and second ratchet members, the cylindrical toothed portion of the second ratchet member having an outer diameter which is less than an outer diameter of the cylindrical toothed portion of the first ratchet member to permit axial movement between the cylindrical toothed portion of the second ratchet member and the cylindrical recess.

30. A method for assembling the locking device defined by claim 1, the method comprising the steps of:

inserting the cam member into the other of the housing members;

inserting the biasing means in the other of the housing members;

inserting the second ratchet member in the other of the housing members such that the biasing means is between the second ratchet member and the cam member;

inserting the first ratchet member in the other of the housing members such that the teeth of the first and second ratchet members engage;

pushing the first ratchet member inside the other of the housing members such that the first ratchet member is entirely received within the other of the housing members;

aligning the housing members;

exerting downward force on the cam member so that the first ratchet member is received in the first of the housing members;

inserting the pivot pin through the housing members, the cam member, the second ratchet member and the first ratchet member;

attaching the pivot pin to the cam member, and;

fixedly attaching the cam pin to the other of said housing members such that the cam pin engages the cam surface.

31. A locking device for pivotally connecting a closure to a support and locking the closure in at least one open position relative to the support, wherein the closure pivots about an axis between a closed position and the at least one open position, said locking device comprising:

a closure-side housing member for fixedly coupling to the closure and a support-side housing member for fixedly coupling to the support;

locking means having a first ratchet member fixedly coupled to one of said housing members, a second ratchet member coupled to the other of said housing members and a biasing means for biasing the first and second ratchet members into engagement with each other, each of the first and second ratchet members having compatible teeth for limiting pivotal movement of the first ratchet member relative to the second ratchet member to a first direction and locking the closure in a set position when said first and second ratchet members are in engagement; and releasing means for disengaging the first and second ratchet members, thereby allowing the closure to pivot in a second direction to the closed position, the releasing means comprising:

a pivot pin received by said housing members and extending along the axis, the second ratchet member being coupled to the pivot pin for movement with the pivot pin in a third direction perpendicular to the first and second directions, thereby disengaging the second ratchet member from the first ratchet member when the pivot pin in moved in the third direction; and a solenoid which moves the pivot pin in the third direction to disengage the first and second ratchet members when the solenoid is activated, thereby allowing the closure-side housing member to pivot in the second direction and close the closure.

32. The locking device as defined in claim 31, wherein the biasing means comprises a spring.

33. The locking device as defined by claim 31, wherein a portion of the locking means and the releasing means is contained within said housing member.

34. The locking device as defined by claim 31, wherein the closure-side housing member and the support-side housing member are hinge leaves and a hinge pin connects the closure-side housing member and support-side housing member in such a manner that the locking device is a hinge.

35. The locking device as defined by claim 34, wherein the locking device is sufficiently strong to support the weight of the closure to which the locking device is mounted.

36. The locking device as defined by claim 31, wherein the locking means is contained within said housing members.

37. The locking device as defined by claim 31, wherein the teeth of the first ratchet member are offset from the teeth of the second ratchet member when the closure is in the closed position such that the teeth of said ratchet members are not fully engaged when the closure is in the closed position.

38. The locking device as defined by claim 31, wherein said first ratchet member comprises a cylindrical toothed portion, said second ratchet member comprises a cylindrical toothed portion and the support-side housing member comprises a cylindrical recess for receiving the cylindrical toothed portions of the first and second ratchet members, the cylindrical toothed portion of the second ratchet member having an outer diameter which is less than an outer diameter of the cylindrical toothed portion of the first ratchet member to permit axial movement between the cylindrical toothed portion of the second ratchet member and the cylindrical recess.

39. A locking device for pivotally connecting a closure to a support and locking the closure a closed position and at least one open position relative to the support, wherein the closure pivots about an axis between the closed position and the at least one open position, said locking device comprising:

a closure-side housing member for fixedly coupling to the closure and a support-side housing member for fixedly coupling to the support;

locking means having a first ratchet member fixedly coupled to one of said housing members, a second ratchet member coupled to the other of said housing members and a biasing means for biasing the first and second ratchet members into engagement with each other, each of the first and second ratchet members having compatible teeth for limiting pivotal movement of the first ratchet member relative to the second ratchet member to a second direction and locking the closure in a set position when said first and second ratchet members are in engagement; and releasing means for disengaging the first and second ratchet members, thereby allowing the closure to pivot in a first direction to an open position, the releasing means comprising:

a pivot pin received by said housing members and extending along the axis, the second ratchet member being coupled to the pivot pin for movement with the pivot pin in a third direction perpendicular to the first and second directions, thereby disengaging the second ratchet member from the first ratchet member when the pivot pin is moved in the third direction; and a solenoid which moves the pivot pin in the third direction to disengage the first and second ratchet members when the solenoid is activated, thereby allowing the closure-side housing member to pivot in the first direction and open the closure.

40. The locking device as defined by claim 39, wherein the biasing means comprises a spring.

41. The locking device as defined by claim 39, wherein a portion of the locking means and the releasing means is contained within the housing members.

42. The locking device as defined by claim 39, wherein the closure-side housing member and the support-side housing member are hinge leaves and a hinge pin connects the closure-side housing member and support-side housing member in such a manner that the locking device is a hinge.

43. The locking device as defined by claim 42, wherein the locking device is sufficiently strong to support the weight of the closure to which the locking device is mounted.

44. The locking device as defined by claim 39, wherein the locking means is contained within said housing members.

45. The locking device as defined by claim 39, wherein said first ratchet member comprises a cylindrical toothed portion, said second ratchet member comprises a cylindrical toothed portion and the support-side housing member comprises a cylindrical recess for receiving the cylindrical toothed portions of the first and second ratchet members, the cylindrical toothed portion of the second ratchet member having an outer diameter which is less than an outer diameter of the cylindrical toothed portion of the first ratchet member to permit axial movement between the cylindrical toothed portion of the second ratchet member and the cylindrical recess.

* * * * *